US005261203A

United States Patent [19]

Yoon

[11] Patent Number: 5,261,203

[45] Date of Patent: Nov. 16, 1993

[54] MOVABLE BARRIER CAPABLE OF DISASSEMBLY

[76] Inventor: Suk Kyu Yoon, 453 Osan-li, Baeksuk-myun, Yangji-Kun, Kyungki-do, Rep. of Korea

[21] Appl. No.: 785,039

[22] Filed: Oct. 30, 1991

[30] Foreign Application Priority Data

May 22, 1991 [KR] Rep. of Korea ..... 91-8222
Sep. 25, 1991 [KR] Rep. of Korea ..... 91-16655

[51] Int. Cl.[5] ..... E06B 3/70

[52] U.S. Cl. ..... 52/455; 52/456; 52/656.4; 52/656.9; 403/231

[58] Field of Search ..... 52/455, 456, 704, 656, 52/586, 457, 458, 305, 656.4, 656.9; 411/44, 55; 49/501; 403/231, 402, 277

[56] References Cited

U.S. PATENT DOCUMENTS

| | | | |
|---|---|---|---|
| 470,995 | 3/1992 | Duchemin | 403/23 X |
| 635,341 | 10/1899 | Nash | 52/656 |
| 1,110,009 | 9/1914 | Ritter | 403/231 |
| 4,012,153 | 3/1977 | Pidgeon et al. | 52/656 X |
| 4,100,834 | 7/1978 | Harris | 411/55 X |
| 4,137,680 | 2/1979 | Donnas | 52/302 X |
| 4,301,629 | 11/1981 | Farr | 52/99 |
| 4,560,311 | 12/1985 | Herb et al. | 411/44 |
| 4,650,384 | 3/1987 | McIntyre et al. | 411/44 |
| 4,656,806 | 4/1987 | Leibhard et al. | 52/704 |
| 4,711,760 | 12/1987 | Blaushild | 411/910 X |
| 4,747,248 | 5/1988 | Fahs | 52/455 |
| 4,842,461 | 7/1989 | Fisher | 411/55 |
| 4,870,797 | 10/1989 | Hagemeiyer | 52/455 |
| 5,042,888 | 8/1991 | Shinjo | 411/44 X |

*Primary Examiner*—Carl D. Friedman
*Assistant Examiner*—Robert J. Canfield
*Attorney, Agent, or Firm*—Morgan & Finnegan

[57] ABSTRACT

A movable barrier capable of disassembly comprises a plurality of rails having at least one hollow at each edges thereof, a pair of stiles having holes formed at the positions of facing to the hollows of the plurality of rails, and means for combining the plurality of rails and the pair of stiles. Since the movable barrier according to the present invention can be disassembled and reassembled, transportation to a desired place is convenient. Further, broken or otherwise damaged portions of the movable barrier can be easily replaced or repaired.

9 Claims, 4 Drawing Sheets

MOVABLE BARRIER CAPABLE OF DISASSEMBLY

FIELD OF THE INVENTION

This invention relates to a movable barrier such as a door, gate, window, screen or the like, more particularly to a wooden door capable of easy assembly and disassembly by means of combining members.

DESCRIPTION OF THE RELATED ART

In a conventional wooden door, the assembling of the door is performed by fixedly inserting tenons on a plurality of the stiles into the corresponding mortises formed with a plurality of rails.

A wooden door of this type has a drawback in that it is inconvenient in transporting and storing the door, and there is a further disadvantage in that if a portion of the door is damaged, repair is very difficult and the replacement of the damaged part is almost impossible due to the inability to disassemble and reassemble the door. Furthermore, the wooden door has another drawback in that the joining between the rails and the stiles is very weak. Accordingly, any gap between the rails and the stiles is widened. Twist of the door is also generated by warp, expansion and contraction of the wood due to weather and other normal variations.

A further wooden door is set forth in Korean Patent No. 39161 in which structural members are fixed by means of metal pipes, e.g. cast iron or steel, thereby preventing twist of the door.

However, a wooden door of this type also has drawbacks arising from the inability of disassembly or reassembly.

SUMMARY OF THE INVENTION

Accordingly, a principal object of the present invention is to provide a movable barrier which can be disassembled and reassembled.

Another object of this invention is to provide a movable barrier easily produced and transported to a desired place.

Still another object of this invention is to provide a movable barrier wherein broken or otherwise damaged portions can be replaced or repaired.

Still another object of this invention is to provide a movable barrier whereby coherence between the rails and stiles is improved by using fixing members so that the incidence of any gap which develops between the rails and stiles is reduced and any gap which might occur can be adjusted.

Still another object of this invention is to provide a movable barrier in which a pane or panel can be inserted without putty.

According to the present invention, the movable barrier commonly swinging on hinges or sliding in grooves comprises a plurality of rails having at least one hollow at each end thereof; a pair of stiles having holes formed at the positions corresponding to the hollows of the plurality of rails; means for combining the plurality of rails and the pair of stiles, each combining means having one side fixed into the hollow of the rail, and the other side passing through the hole of the stile and combining the stile to the rail; and at least one panel member disposed between the rails and the stiles.

Other features and operations of the present invention will become apparent from the following detailed description of the invention when taken in conjunction with the accompanying drawings.

DESCRIPTION OF THE PREFERRED EMBODIMENT

Figure 1:
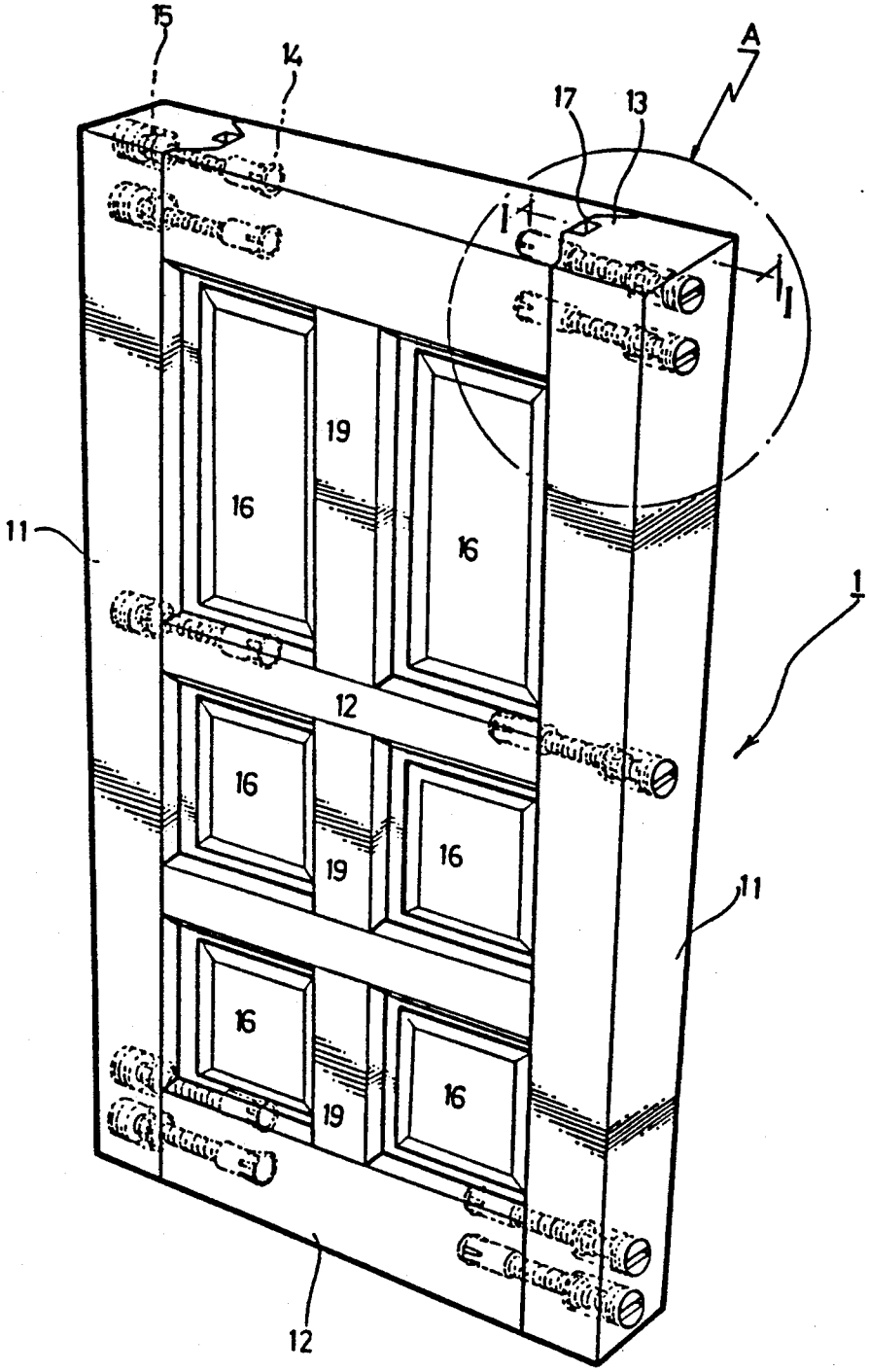
FIG.1 is a perspective view of a wooden door according to the invention.

A wooden door according to the invention comprises, as shown in FIG.1, two stiles 11 disposed to the edges of the door i, three rails 12 disposed at the top, middle and lower portions respectively between the two stiles 11, anchor bolt sets 14 each of which tightens a stile and a rail with a nut 15, and panel members 16. The stiles 11 and the rails 12 are assembled with anchor bolt sets 14 and nuts 15 facing together the prominent portion 13 of the stile 11 and the depressed portion 17 of the rail 12, provided on the corresponding adjacent surface. Panel members 16 of various shapes and materials are provided between the stiles and rails 12 through supporting mullions 19.

Figure 2A:
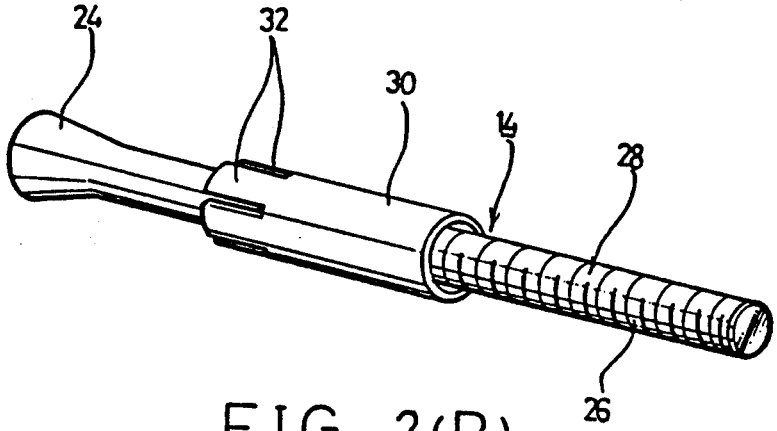
FIG.2A is a perspective view of an anchor bolt according to the invention.
Figure 2B:
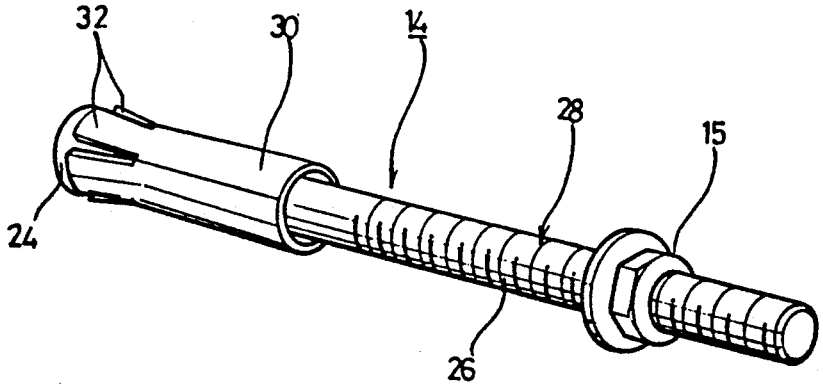
FIG.2B is a perspective view showing a state of the anchor bolt when tightened with a nut in joining the rail and the stile.

FIG.2A is a perspective view of the anchor bolt set 14. As shown in FIG.2A, the anchor bolt set 14 includes a conical shaped head 24, a body 28 provided with a thread 26, and a round shaped metal tube 30 having several wings 32 incised on one end thereof. This round shaped metal tube 30 is for improving coherence when fixedly inserted into a hollow of the rails 12. The several wings 32 are expanded outwardly so as to strongly fix in the hollow of the rail 12 as shown in FIG.2B.

The internal diameter of the round shaped metal tube 30 is smaller than the maximum diameter of the head 24 and is larger than the diameter of the body 28. Reference Nos. 15 and 18 represent a nut and a washer respectively.

Figure 3A:
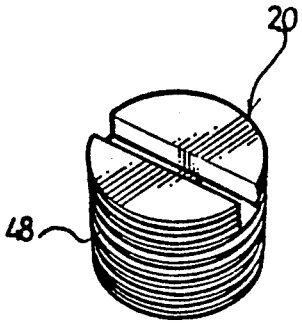
FIG.3A is an upper perspective view of a plug used in this invention.
Figure 3B:
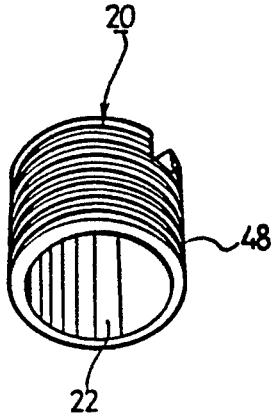
FIG.3B is a lower perspective view of the plug.

FIG.3 is a perspective view of plug 20. The plug may be formed, for example, of plastic molded into the shape of a round pipe having a thread 48 on its external surface and a cross shaped groove or wrench groove at its one end. The inside of the plug 20 is preferably empty to improve elasticity. The plug 20 is threaded into a hole formed in the stile in order to close the hole from the outside.

Figure 4:
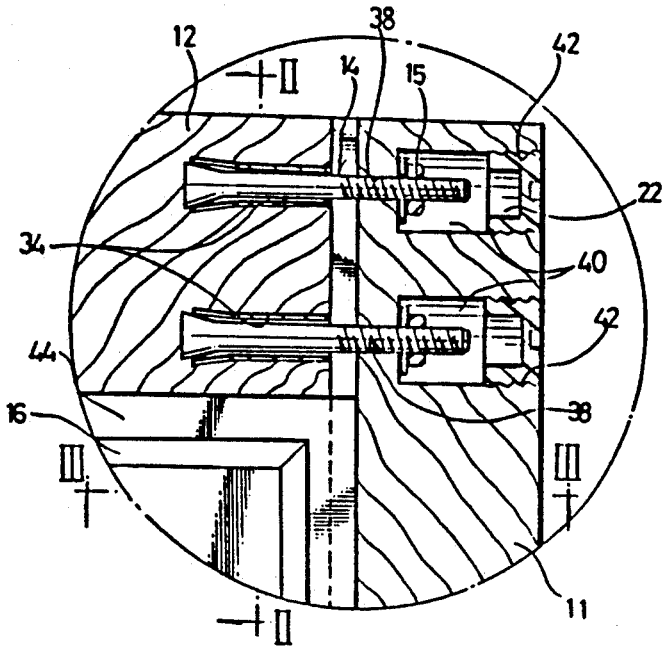
FIG.4 is an enlarged cross-sectional view of part A taken on line I—I of FIG.1.
Figure 6:
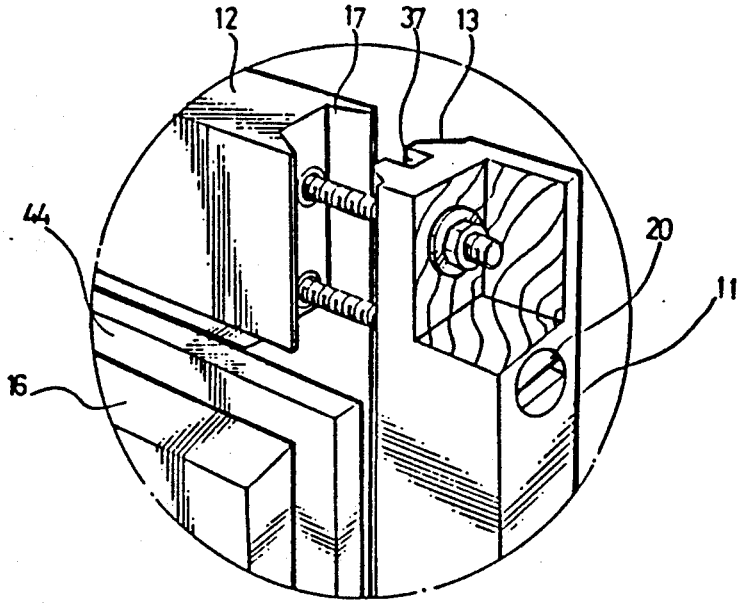
FIG.6 is an exploded perspective view of the enlarged part A shown in FIG.1.

FIG.4 is an enlarged cross-sectional view of part A taken on line I—I of FIG.1, and FIG.6 is an exploded perspective enlarged view of part A shown in FIG.1. In the rail 12, several hollows 34 for fixing anchor bolt set 14 are provided as shown in FIG.4. The hollow 34 has a uniform diameter, the anchor bolt set 14 is pressed into the hollow 34 so that the several wings 32 of the round shaped metal tube 30 are expanded by the conical shaped head 24 to adhere closely as shown in FIG.4.

Stile 11 has holes, passing through the stile at the positions corresponding to the hollows 34 of the rail for receiving the body 28 of the anchor bolt set 14. Each hole 36 is formed with a stepped shape having different diameters. The diameter of the first hole 38 is larger than the diameter of the body 28 of the anchor bolt set 14 and smaller than the external diameter of the nut 15. The diameter of the second hole 40 is larger than the external diameter of the nut 15 so that the nut 15 can be combined with the anchor bolt set 14 therein.

Figure 5A:
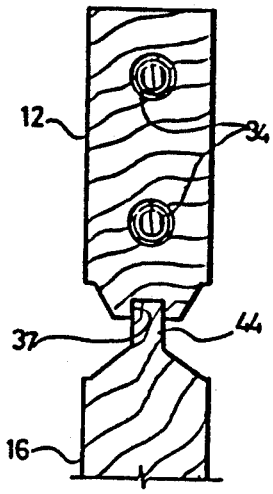
FIG.5A is a cross-sectional view taken along a line II—II shown in FIG.4.
Figure 5B:
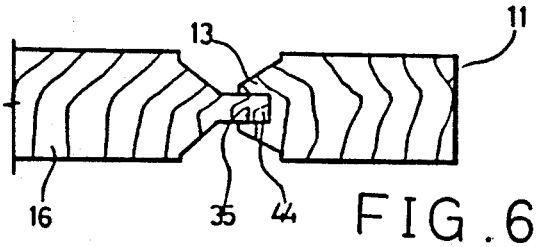
FIG.5B is a cross-sectional view taken along a line III—III shown in FIG.4.

FIG.5A is a cross-sectional view taken along a line II—II shown in FIG.4, and FIG.5B is a cross-sectional view taken along a line III—III shown in FIG.5. Border portion 44 of the panel member 16 protrudes so that the border portion 44 of the panel member 16 is loosely inserted into grooves 35 and 37 provided in the stile 11 and the rail 12 respectively. Accordingly, although the stile and the rail 12 are deformed, the panel member 16 is not deformed.

Assembling the wooden door of the aforedescribed construction according to the invention will be explained in detail hereafter with reference to FIGS.1 to 6. The anchor bolt set 14 is fixed into the hollow 34. The body 28 of the bolt protruding from the rail 12 is inserted into the hole 36 and is tightened by the washer 18 and the nut 15, so, that the stile 11 and the rail 12 is assembled strongly. Specifically, on tightening the anchor bolt set 14 with the nut 15 and the washer 18 the anchor bolt set 14 is pulled, thus the several wings 32 of the round shaped metal tube 30 are expanded outwardly, thereby combining the stile 11 and rail 12 strongly. Thereafter, the plug 20 is threaded into the hole 40.

In an embodiment of this invention, ten anchor bolts having 9 mm diameter of which a coherence is about 1,200 kg per anchor bolt are used, thus a total coherence is about 12,000 kg.

Before completely combining the rails and stiles, the panel members 16 and the mullion members 19 are assembled between the rails and stiles inserting the border portion 44 of each member into the grooves 35 and 37 provided with the rails and stiles. The disassembling of the same is executed by a reverse sequence.

Figure 7:
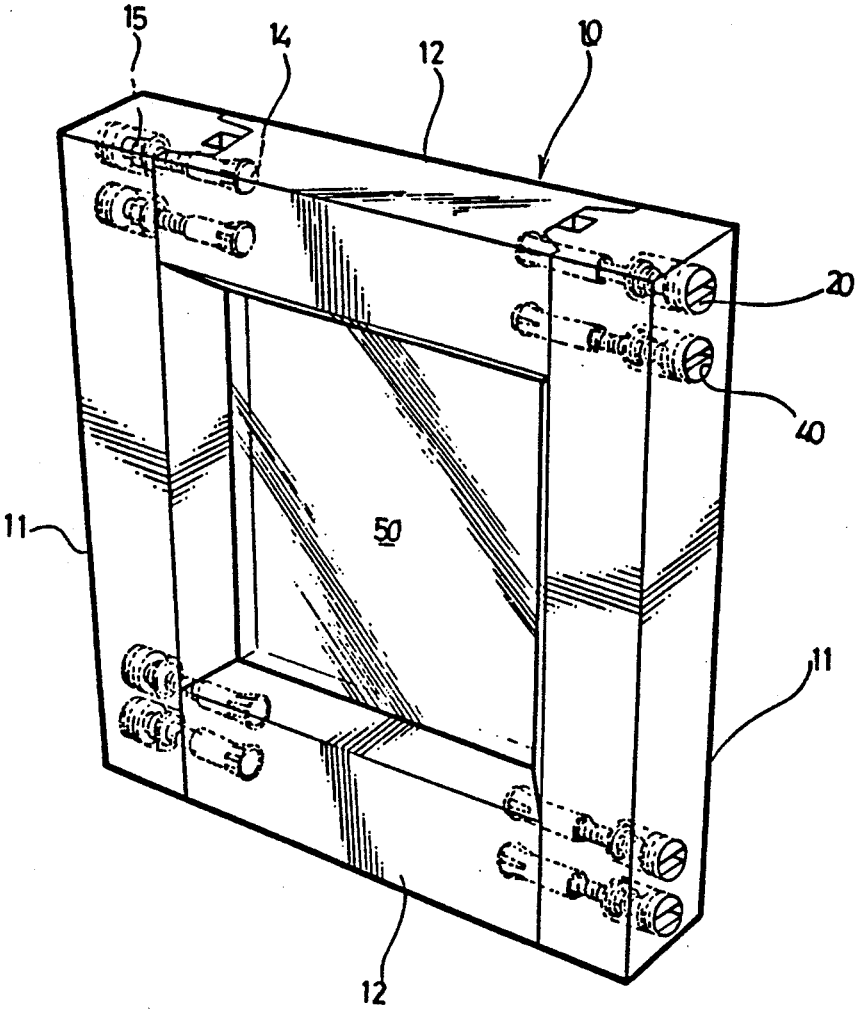
FIG.7 is a perspective view of a wooden window according to another embodiment of this invention.

FIG. 7 is a perspective view of a wooden window according to another embodiment of this invention. This embodiment is identical to the embodiment shown in FIG. 1, except that the panel member is a pane 50 and the rail in the middle portion of the door does not exist. But, it is to be sure that the rail 12 may be disposed at the middle portion of the stiles 11 and the panel members 16 may be divided in accordance with the size of a window. The pane 50 is inserted into the corresponding grooves(not shown in FIG.7) of the rails 12 and the stiles 11 and assembled before fixing the rails 12 and the stiles 11. Accordingly, there is no need to use putty for fixing the pane 50 to the rails and stiles.

As can be seen from the foregoing, the movable barrier according to the present invention can not only be easily assembled but also be disassembled. The movable barrier of the present invention is conveniently transported. Further, broken or otherwise damaged portions of the movable barrier can be replaced or repaired. Furthermore, the movable barrier according to the present invention provides an improved movable barrier having less probability of gap occurrence between the rails and stiles due to warp, expansion or contraction thereof.

While the invention has been described with reference to preferred embodiments, the description is illustrative of the invention and is not to be construed as limiting the invention. Various modifications and applications wherein materials of construction may be various kinds of metals, plastics and the like for use as gates, screens, windows and the like may occur to those skilled in the art without departing from the scope and spirit of the invention defined by the appended claims.

What is claimed is:

1. A movable barrier of the type commonly installed for swinging on hinges or sliding in grooves, said barrier being capable of repeated assembly and disassembly and comprising:

a pair of stiles for forming sides of the movable barrier when assembled, each said stile having holes extending therethrough at predetermined locations;

a plurality of rails for maintaining said stiles in spaced apart relation when said movable barrier is assembled, each rail having at least one hollow at each end thereof to be aligned with one of the holes formed in an adjacent stile when said movable barrier is assembled, each aligned hollow and hole forming a passage extending a limited distance into its corresponding rail;

means associated with each aligned hole and hollow for combining the plurality of rails and the pair of stiles together into the assembled movable barrier, each said combining means having a first portion fixed into one of the hollows of the rail, and a second portion passing through the hole of the stile aligned with said one hollow, said combining means being capable of multiple tightenings and untightenings and each said combining means including:

an anchor bolt having a threaded body portion terminating in a radially outwardly flaring conical head at one end, said conical head residing within a hollow and having a predetermined maximum outer diameter, a unitary cylindrical sleeve member surrounding said threaded body portion, said sleeve member having an internal diameter smaller than said maximum outer diameter of said conical head and said sleeve member having a plurality of wing sections at one end adjacent said conical head for expanding radially outwardly when engaged by said conical head, and a nut member threadably engaging said threaded body portion for advancing said sleeve member against said conical head to cause said wings to expand radially outwardly; and at least one panel member disposed between said pair of stiles and between a pair of adjacent rails to form a solid movable barrier when assembled, with said stiles and adjacent rails cooperating for rigidly supporting each said panel member to form a generally solid movable barrier when said combining means are fully tightened yet allow disassembly of said movable barrier when said combining means are untightened, such that the movable barrier can be easily and repeatedly assembled and disassembled.

2. A movable barrier capable of disassembly according to claim 1, wherein each said hole in a stile is formed with a stepped shape having a firsf hole portion therein of a diameter larger than the diameter of the threaded body of the anchor bolt and smaller than the external diameter of the nut, and having a second hole portion therein of a diameter larger than the external diameter of the nut, said first and second hole portions being aligned with each other to form said passage for receiving said anchor bolt.

3. A movable barrier capable of disassembly according to claim 2, wherein the second hole is threaded.

4. A movable barrier capable of disassembly according to claim 2 further comprising a plug member threaded into the second hole portion of the stile for closing the hole from the outside.

5. A movable barrier capable of disassembly according to claim 4, wherein the plug is formed of plastic molded into the shape of a round pipe having an empty inner portion for improving elasticity.

6. A movable barrier capable of disassembly according to claim 4, wherein the plug has a wrench groove at its one end surface.

7. A movable barrier capable of disassembly according to claim 1, wherein at least one said panel member of said barrier is a pane.

8. A movable barrier capable of disassembly according to claim 1, wherein each said panel member has a border portion projecting outwardly from its side edges, and said rails and stiles include inwardly facing, complementary grooves to receive said border portion for supporting said panel member in a fixed position when said stiles, rails and panel members are assembled together upon fully tightening said combining means.

9. A movable barrier capable of disassembly according to claim 8, wherein the inwardly facing complementary grooves are formed in a projecting edge portion of said stiles and wherein each rail includes depressions in its ends, said projecting edge portions of said stiles and said depressions in said rails being generally complementary to each other to interfit with each other such that the stiles and rails are rigidly affixed to each other and rigidly support each said panel member in a generally unitary structure when said combining means are tightened.

* * * * *